US006561886B2

(12) United States Patent
Roberts et al.

(10) Patent No.: US 6,561,886 B2
(45) Date of Patent: May 13, 2003

(54) DEVICE FOR RETAINING ABRASIVE PAD ON LAP IN EYEGLASS LENS MAKING APPARATUS

(75) Inventors: Douglas J. Roberts, Ellington; Jonathan Dooley, Bolton; Lawrence Wolfson, West Hartford; Michael J. Goulet, Amston; Jeffrey Murray, Ellington, all of CT (US)

(73) Assignee: Gerber Coburn Optical Inc., South Windsor, CT (US)

( * ) Notice: Subject to any disclaimer, the term of this patent is extended or adjusted under 35 U.S.C. 154(b) by 0 days.

(21) Appl. No.: 09/741,295

(22) Filed: Dec. 19, 2000

(65) Prior Publication Data

US 2001/0003086 A1 Jun. 7, 2001

Related U.S. Application Data

(62) Division of application No. 09/452,579, filed on Dec. 1, 1999.

(51) Int. Cl.[7] ..... B24B 9/00

(52) U.S. Cl. ..... 451/277; 451/384; 451/421; 451/921

(58) Field of Search ..... 451/364, 384, 451/921, 277

(56) References Cited

U.S. PATENT DOCUMENTS

| | | | | |
|---|---|---|---|---|
| 1,626,025 A | | 4/1927 | Dake et al. | |
| 4,274,232 A | * | 6/1981 | Wydle | 51/358 |
| 4,733,502 A | | 3/1988 | Braun | |
| 5,095,660 A | * | 3/1992 | Dillon | 51/58 |
| 5,494,474 A | * | 2/1996 | Vernon | 451/364 |
| 5,605,501 A | | 2/1997 | Wiand | |
| 5,660,581 A | | 8/1997 | Shin et al. | |
| 5,676,590 A | | 10/1997 | Hiraoka | |
| 5,951,375 A | * | 9/1999 | Mandler | 451/42 |
| 6,077,148 A | | 6/2000 | Klein et al. | |
| 6,089,963 A | | 7/2000 | Wiand et al. | |
| 6,110,017 A | * | 8/2000 | Savoie et al. | 451/42 |
| 6,375,554 B1 | * | 4/2002 | Murray et al. | 451/42 |

FOREIGN PATENT DOCUMENTS

| | | |
|---|---|---|
| CH | 75480 | 1/1917 |
| EP | 0 850 726 | 1/1998 |
| GB | 804871 | 2/1957 |
| GB | 840781 | 11/1957 |
| GB | 1 321 931 | 5/1971 |
| GB | 1 321 931 | 10/1971 |
| GB | 2050884 | 6/1979 |
| GB | 2 050 884 A | 3/1980 |
| GB | 2 050 884 A | 6/1980 |
| JP | 010027846 | 4/1987 |
| JP | 090150362 | 11/1995 |
| WO | WO 00/32353 | 1/1999 |
| WO | WO 00/32353 | 8/2000 |

* cited by examiner

*Primary Examiner*—Joseph J. Hail, III
*Assistant Examiner*—Lee Wilson
(74) *Attorney, Agent, or Firm*—Cantor Colburn LLP

(57) ABSTRACT

A retainer for retaining an abrasive pad on a lens making machine and an abrasive pad adapted to such retention comprises a retainer nestable with a lap of a lens making machine wherein when such retainer is nested, a pad placed upon the lap before nesting will be trapped in the desired position. The pad of the invention includes radially outwardly extending members beyond the working area of the pad whose purpose is to be trapped by the retainer. The invention enables automatic loading and unloading of pads on the lens making machine.

10 Claims, 6 Drawing Sheets

DEVICE FOR RETAINING ABRASIVE PAD ON LAP IN EYEGLASS LENS MAKING APPARATUS

CROSS-REFERENCE TO RELATED APPLICATION

This application is a Divisional application of U.S. Ser. No. 09/452,579 filed Dec. 1, 1999.

BACKGROUND OF THE INVENTION

1. Field of the Invention

The invention relates to the field of eyeglass lens production. More particularly, the invention relates to a device for retaining an abrasive pad on a lap for fining and polishing of lenses.

2. Prior Art

Ophthalmic and other types of lenses are typically produced from lens blanks of glass or plastic having two major surfaces, one of which is typically finished, and the other of which is unfinished. Cutting, fining, and polishing operations are performed on the unfinished surface of the lens blank by a machine responsive to data corresponding to a particular lens prescription. The cutting operations are usually accomplished by employing a ball mill for plastic lenses, or a grinder for glass lenses. These cutting operations generally create a lens surface closely approximating the shape of the finished lens. However, the cut surface of the lens blank is often rough and requires that subsequent fining and polishing operations be performed on the lens blank to achieve the requisite optical clarity.

The fining and polishing operations are ordinarily performed by engaging the cut surface of the lens blank with an abrasive surface having a shape that closely approximates the desired finished shape of the lens as defined by the lens prescription. This abrasive surface is referred to by those skilled in the pertinent art as a tool or "lap". During operation, the device to which the lens blank is mounted, moves the blank over the abrasive surface of the lap along a conforming contoured semi-spherical path, thereby fining and/or polishing the lens surface. Laps generally consist of two main components, a mounting surface or mandrel, and a removable abrasive pad that mounts on the mandrel and against which the lens blank is moved during fining and polishing operations. The shape of the mandrel must conform as closely as possible to the prescribed shape of the lens, therefore, different lens prescriptions require different laps to be used.

During fining and polishing operations, it is often necessary to lift the lens blank off of the lap and rinse the abrasive pad to remove lens material in the form of particulate that has built-up during the fining and/or polishing operations. To conventionally prevent the abrasive pad from separating from the mandrel during rinsing, a releasable adhesive is used to bond the pad to the mandrel. A difficulty associated with adhesively attaching the abrasive pad to the mandrel is that after extended periods of use it is often necessary to change abrasive. The adhesive can make separating the abrasive pad from the mandrel difficult and time consuming. In high production situations where abrasive pads are regularly replaced, significant amounts of time can be lost separating the abrasive pad from the mandrel, thereby adding to the time and expense associated with preparing lenses. For these reasons, the art is in need of an alternate pad retaining system which avoids lost time in connection with changing pads while concurrently also rendering the changing operation significantly less difficult.

SUMMARY OF THE INVENTION

The above-identified drawbacks of the prior art are overcome or alleviated by the pad retaining system of the invention.

The invention introduces unconventional pad geometry and an unconventional lap support. The features of these two elements function together to provide quick, easy and reliable pad retention on the lap while eliminating the difficulty of removal of the pad experienced by the prior art. The invention further renders such removal and replacement a very time efficient operation.

The pad of the invention is oversized relative to conventional designs to provide surface area upon which to clamp without reducing the working abrasive surface of the pad. Pads generally are defined within a circle having a diameter of about three inches. The pads of the invention are defined by a circle having a diameter of about four and one-half inches. This provides a three quarter inch annular section of pad upon which to clamp the same. Adhesive is not required.

Complementary to the pad described, a lap support including an actuator and a retainer are provided. The retainer is moveable between two positions: the first in which it is in close proximity to the surface of the lap and the second in which it has been distanced from the surface of the lap. In the first position, a pad is compressively retained between the retainer and the lap with compression being placed upon the annular area of the pad described. In the second position the compressive force of the first position is absent and a pad may be either removed from the lap or placed thereon.

The retainer is actuated to move to the first and second positions by solenoid which is/are connected thereto through connecting rods. The retainer can be operated manually or automatically in response to conditions of the system.

A significant benefit of the retainer system is that it allows automation of pad placement and replacement. Since adhesive is not required to retain the pad on the lap, a vacuum cup on a pick and place machine is employed to place and replace pads on the lap for retention without human intervention.

BRIEF DESCRIPTION OF THE DRAWINGS

Referring now to the drawings wherein like elements are numbered alike in the several Figures.

DETAILED DESCRIPTION OF THE INVENTION

Figure 1:
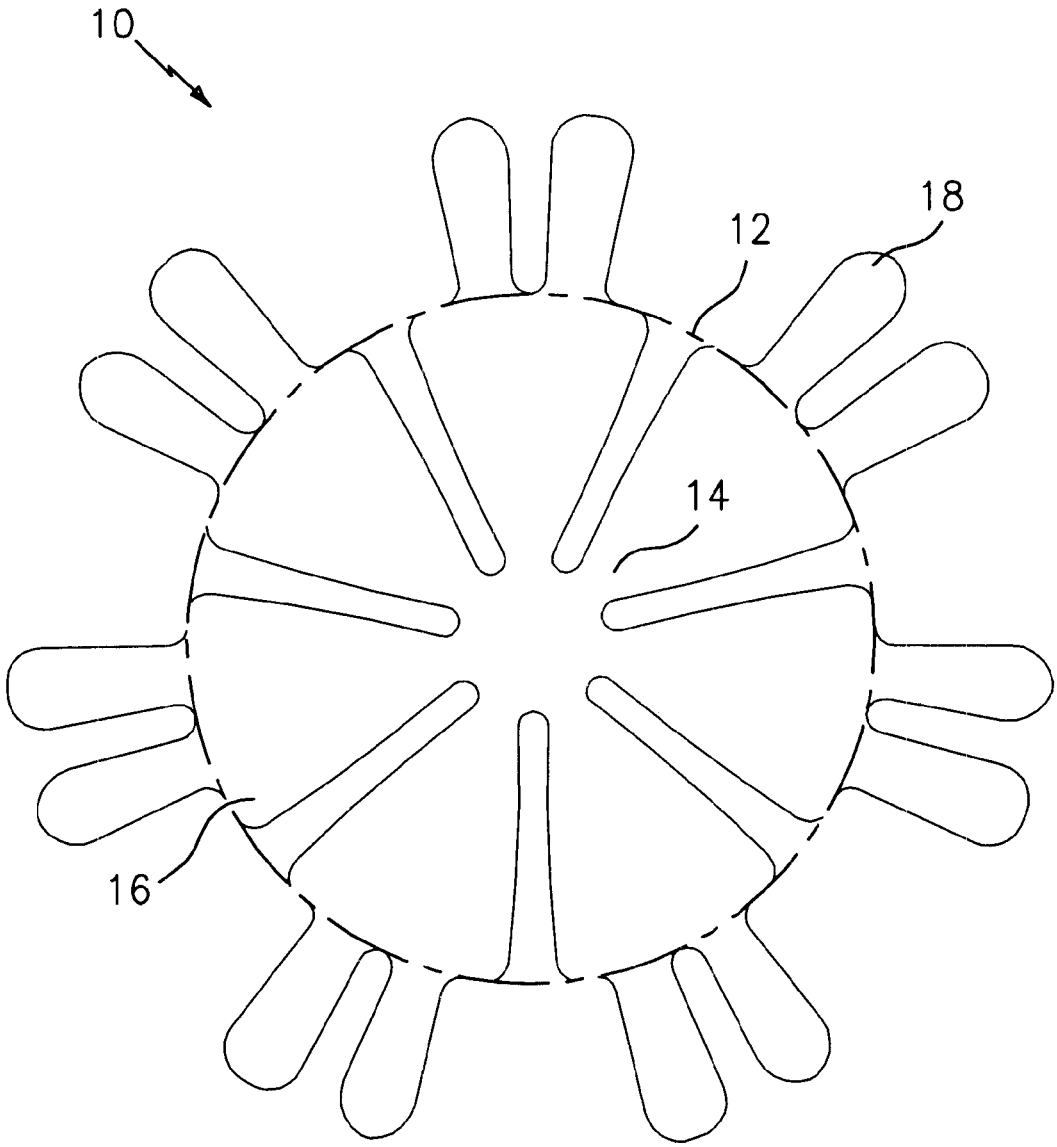
FIG. 1 is a plan view of a pad in accordance with the present invention.

A pad 10 of the invention will be understood by reference to FIG. 1. In order to simplify the discussion of the shape of the pad it is noted that a circumscription line 12 is a defining line which can be used for purposes of this discussion to delineate between a working area of the pad (inside line 12) used for fining and polishing (collectively referred to as "conditioning" herein) of a lens blank and a hold-down area of the pad exterior to circumscription line 12 which is used to retain the pad on the lap during conditioning operations. The portion interior to line 12 includes, in one embodiment, a central section 14 and a plurality of petals 16 (illustrated as seven). This portion of the design is known to the art and is currently used with adhesive backing in the conventional manner. The arrangement of petals and the mode of operation of the particular dimensions are known to the art.

Outwardly of line 12, it will be appreciated by review of FIG. 1, each petal 16 includes radially outwardly extending members 18 which in a preferred embodiment are about three-quarters inch long. Preferably, two members 18 are provided on each petal 16 each being about one-third inch wide. The arrangement is preferred because it facilitates balanced retention of the pad by the retaining device discussed herein below. It will be understood however that a single member 18 could be used if desired bearing in mind that the width of the member is adjustable as desired. If members 18 are made wider, materials cost is increased; if they are made thinner, structural integrity will be diminished. Thus, the width of members 18 requires consideration to balance these issues.

The particular configuration of the two members 18 in a preferred embodiment (shown) is that they are spaced from one another on each petal 16 by about a quarter inch and that they are radiused. The configuration is preferred because it reduces the amount of material necessary to provide good retention of pad 10 in the retaining device of the invention. It will be understood that one could simply extend the radial length of petals 16 and achieve the function of the invention. More material, however, would be used in this instance and material cost would be undesirably increased. Thus, the configuration shown is preferred. It is also contemplated that one of ordinary skill in the art following exposure to this disclosure will be capable of producing other designs which fall within the scope of the invention and maintain the benefits thereof.

Figure 2:
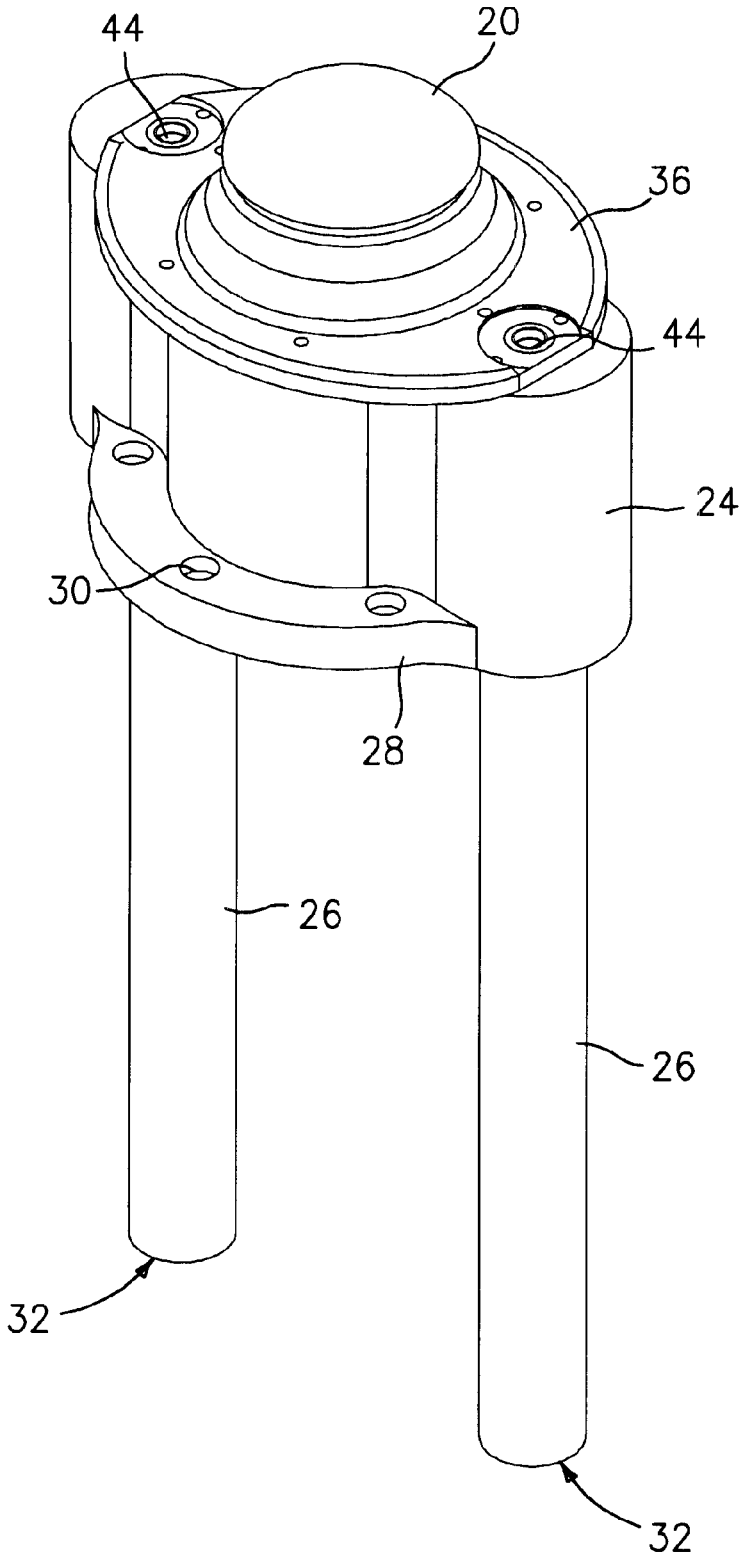
FIG. 2 is a perspective view of a retaining device in accordance with the present invention, with the retaining device in a first (closed) position.
Figure 3:
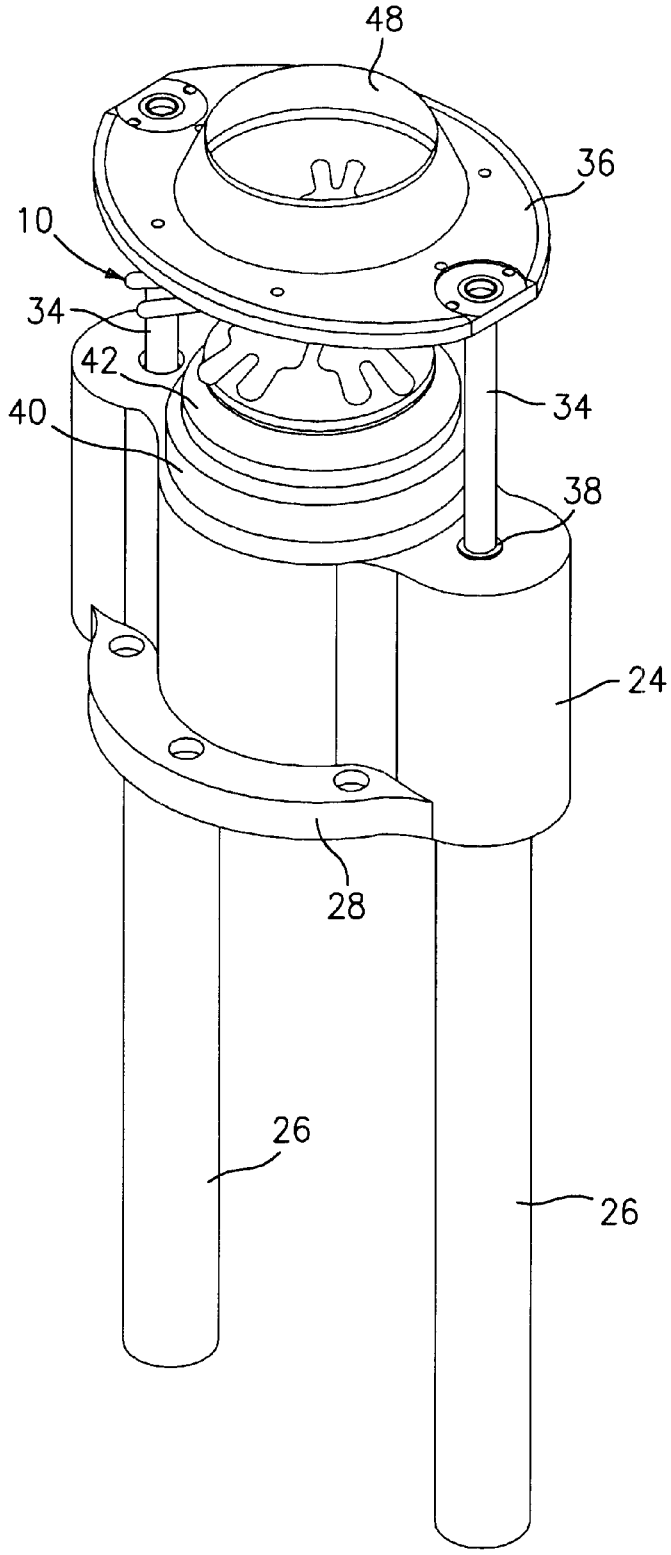
FIG. 3 is a perspective view of the retaining device of FIG. 2 in a second (open) position.
Figure 4:
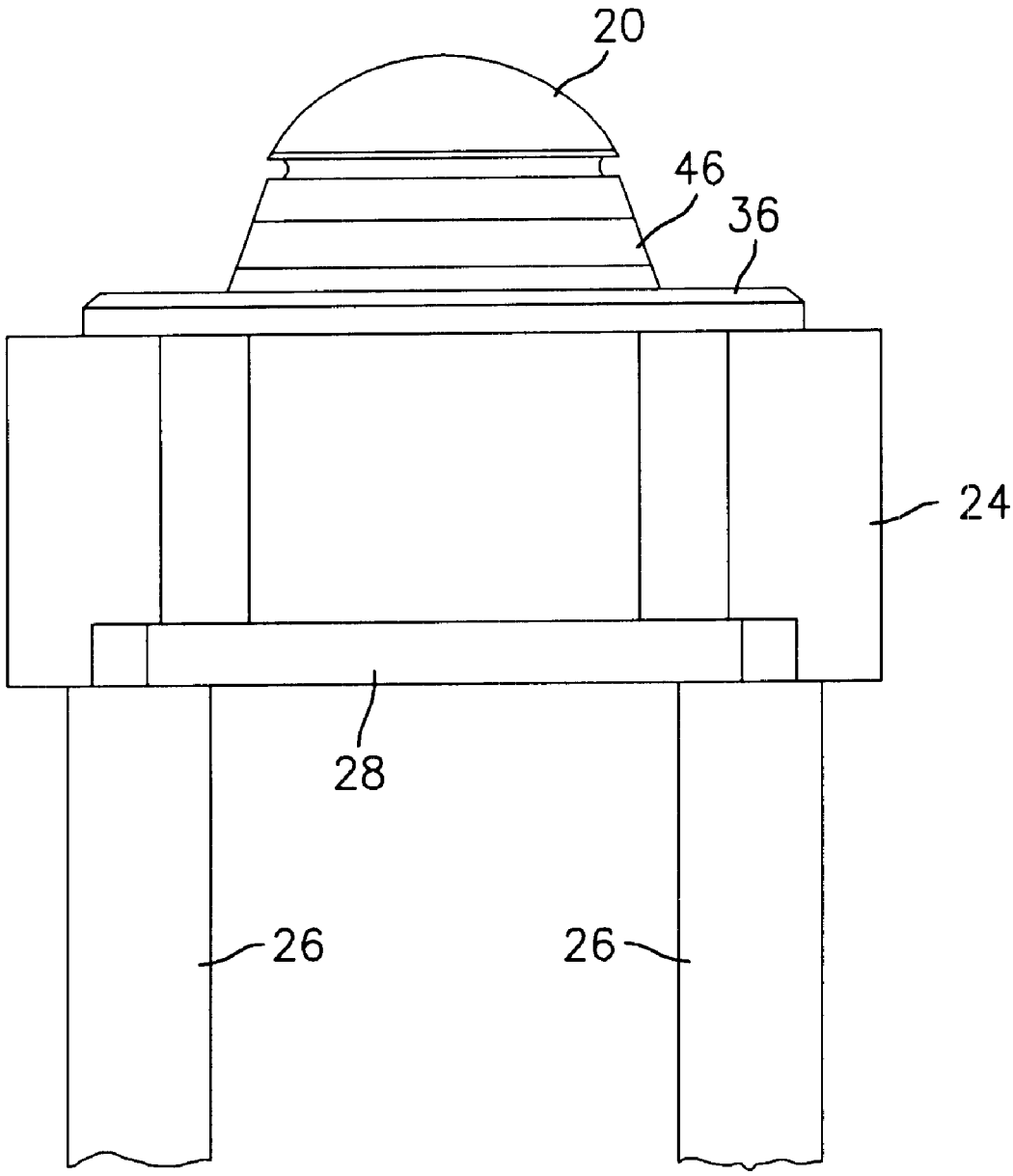
FIG. 4 is a side elevation view of the retaining device of FIG. 2 in the first (closed) position.

Referring to FIGS. 2 and 3, the retaining device of the invention is illustrated in the closed and open positions, respectively. It will be appreciated that the device as illustrated is combinable with any type of lens conditioning machine and would replace the lap and lap support of those machines.

In a preferred configuration, a lap 20 is attached to a lap cradle 24. Cradle 24 is attached to a pair of tubes 26 which are preferably received in recesses at a bottom surface 28 of cradle 24. Tubes 26 are secured in this location by any number of known means. Cradle 24 further includes a mounting flange 28 with several bolt holes 30 for connection with the machine 35. The tubes 26 are supported at bottom ends 32 by an appropriate portion of the lens blank conditioning machine 35. Tubes 26 house connecting rods 34 (FIG. 3) which actuate a retainer 36. Rods 34 are bushed in tubes 26 by bushings 38 which preferably are constructed of bronze. Connecting rods 34 are actuated preferably by solenoids 33 mounted on the lens blank conditioning machine 35. A preferred throw of the solenoids 33 is illustrated by the difference in position of retainer 36 relative to cradle 24 in FIGS. 2 and 3 or 4 and 5. As will be appreciated, the space created enables easy and effective manipulation of a conditioning pad.

Lap 20 itself is supported by a cylindrical tower (support) 40 mounted directly to cradle 24. A frustoconical skirt 42 (a part of lap 20) is mounted atop tower 40.

Retainer 36 is fixedly attached to connecting rods 34 at connecting sites 44 and is maintained in the fixed condition therewith by threaded fasteners. Centrally to retainer 36 is a frustoconical protuberance 46 out of plane with the balance of retainer 36, which protuberance 46 is at an angle to substantially nest with the frustoconical tower 40 and skirt 42 of lap 20. It is the nestability of these compartments that provides the compression force on the members 18 of pad 10 when the retainer 36 is in the closed position. The protuberance 46 may be integral with retainer 36 but in a preferred embodiment is a separate structure which is attached to retainer 36 by threaded connection or other reliable fastening arrangement.

Figure 5:
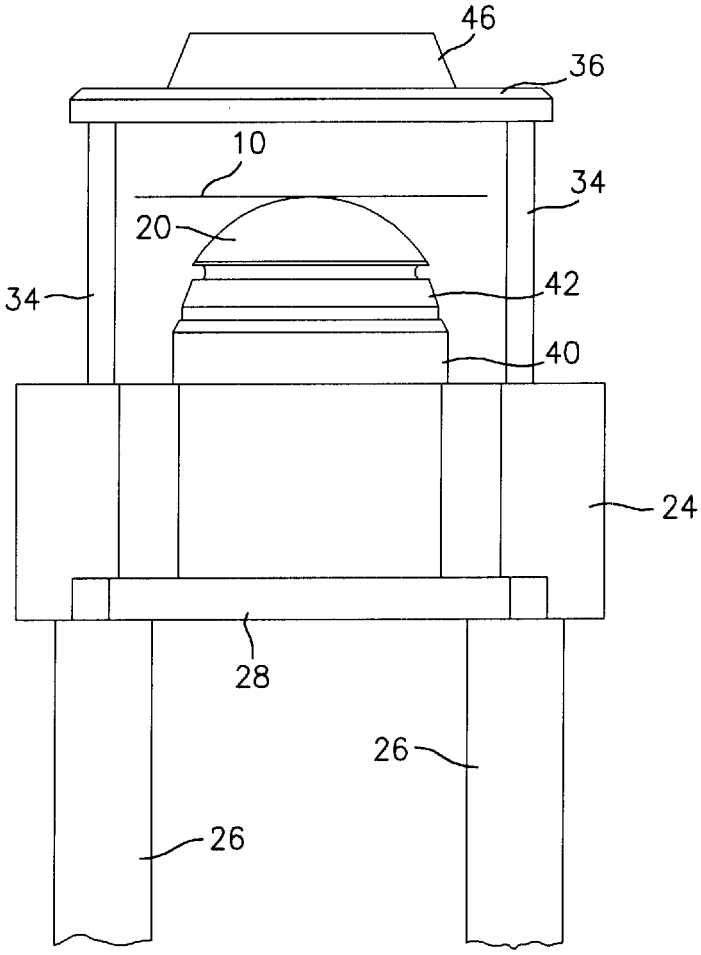
FIG. 5 is a side elevation view of the retaining device of FIG. 3 in the second (open) position.
Figure 6:
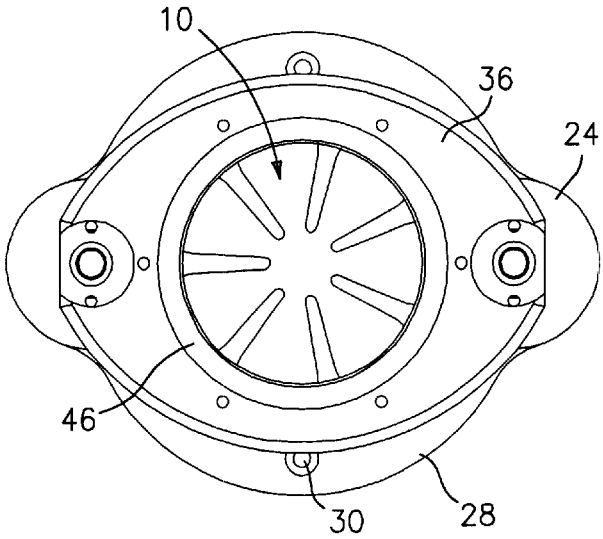
FIG. 6 is a top plan view of the retaining device of FIG. 2.

In operation, which can be well understood by a review of FIG. 5 in connection with the discussion hereunder, the device is opened by solenoids 33 and a pad 10 is placed in a centered relationship over lap 20. It should be recognized that no adhesive is employed in a preferred embodiment although one could employ adhesive if desired. Adhesive use would reduce the ease of removal of the pad from the lap 20. Once the pad 10 is properly positioned atop lap 20, retainer 36 is brought downwardly and into close proximity or contact with carrier 24. This action allows an inside surface 48 (FIG. 3) of protuberance 46 to come into contact with members 18 of pad 10. The contact causes members 18 to bend downwardly toward frustoconical tower 40 and skirt 42 and become trapped against those features by inside surface 48. In this condition, pad 10 is reliably retained on lap 20 and is ready for use. To change pads, the retainer 36 is raised to the second position and the pad is easily removed and replaced with another.

Figure 7:
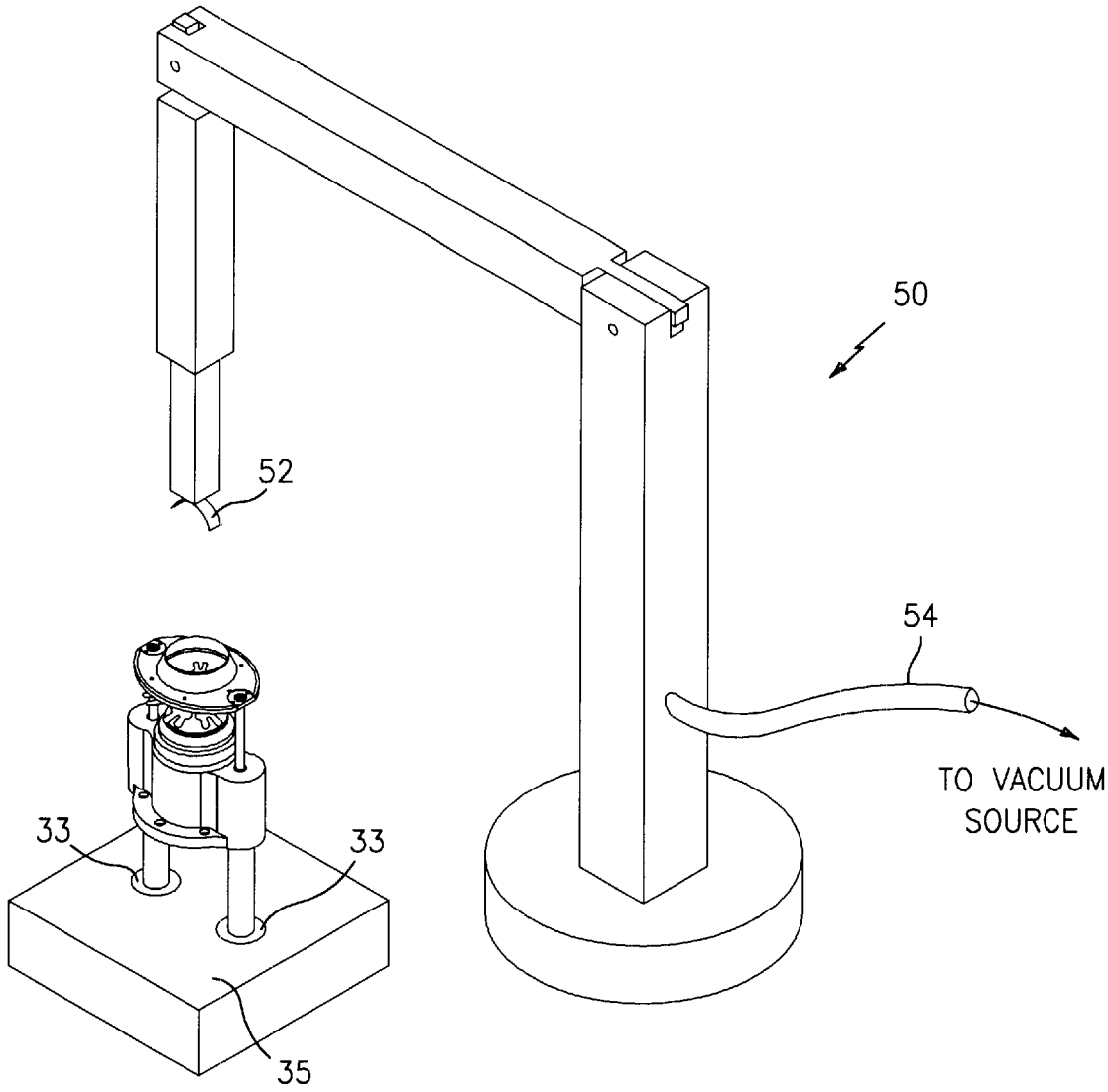
FIG. 7 is a schematic perspective view of an automatic loading and unloading system in accordance with the present invention.

The device described above allows for fully automatic initial placement of a pad and the replacement thereof. A conventional pick and place machine 50 illustrated schematically in FIG. 7 is modified to support a vacuum cup 52 of the operational end thereof. Machine 50 preferably is attached to a vacuum source via a line 54 or may provide its own vacuum source as desired. Machine 50 is programmable to take certain actions based upon sensor stimuli or passage of time. In the automatic system of the invention the action of the pick and place machine 50 will be to retrieve a first pad using vacuum and place it on the lap while the retainer 36 is in the open position. In one embodiment, the vacuum cup 52 is of a diameter that allows it to pass through the opening of retainer 36 to properly position the pad 10 on lap 20. Machine 50 then allows sufficient time for retainer 36 to trap pad 10 as hereinbefore described and then releases the vacuum on the pad. The machine is then moved clear of the lap and pad and the lens procedure may continue or begin.

According to its programming, the pick and place machine 50 will return to lap 20 and by vacuum, attach itself to pad 10 when that pad is to be removed. Retainer 36 will release pad 10 and machine 50 will move to a discard area and release vacuum to deposit the spent pad in this area. Machine 50 will then retrieve a new pad and place it on the lap as described above. Preferably, and in order to streamline the automatic operation, the new pads will be stored in a cylindrical housing so that the pick and place machine will only need to move to one place to pick up a pad. This entire operation is performable without human intervention and speeds the lens making process.

It should be noted that the particular embodiment of the automatically loadable system of the invention wherein the pad is deposited and removed from lap 20 from above the retainer 36 is but one preferred embodiment and that machine 50 would be configured to deposit and withdraw pads from a side of lap 20 as well, if desired.

In one embodiment of the invention, a controller is electrically connected to the lap retainer and the pick and place machine to coordinate movements. Moreover, sensors may be employed in various locations and for various purposes within the invention. One such purpose is to monitor the condition of a pad retained on the lap to determine when the pad requires replacement. The sensor is connected to the controller and the controller acts on a previously provided program upon receiving a signal from the sensor.

The invention dramatically reduces the prior art's lost time for changing pads by economically providing the alternative of the foregoing embodiment of the invention.

While preferred embodiments have been shown and described, various modifications and substitutions may be made thereto without departing from the spirit and scope of the invention. Accordingly, it is to be understood that the present invention has been described by way of illustration and not limitation.

What is claimed is:

1. A lens conditioning pad retainer comprising:

a lap cradle;

a lap mounted to said cradle; and a retainer mounted to a connecting rod, which connecting rod positions said retainer to hold said pad against said lap and which connecting rod positions said retainer spaced from said lap.

2. A lens conditioning pad retainer as claimed in claim 1 wherein said retainer when holding said pad against said lap is securable in such position.

3. A lens conditioning pad retainer as claimed in claim 1 wherein said retainer includes a frustoconical protuberance which nests with a base of said lap when said retainer is holding said pad against said lap.

4. A lens conditioning pad retainer as claimed in claim 3 wherein said nested protuberance traps a hold-down area of a lens conditioning pad against said lap.

5. A lens conditioning retainer as claimed in claim 1 wherein said retainer is actuated to one of said positions by at least one solenoid.

6. A lens conditioning retainer as claimed in claim 5 wherein said at least one solenoid is connected to said retainer by said connecting rod.

7. A lens conditioning system comprising:

a lap support;

a lap mounted to said support;

a lens conditioning pad retainer mounted to a connecting rod which connecting rod is configured to move said retainer between a first position wherein the retainer is in nested communication with said lap and a second position wherein said retainer is spaced from said lap; and a lens blank carrier which positions a lens blank in operable communication with said lap.

8. A lens conditioning system as claimed in claim 7 wherein said lap support comprises a machine housing and a lap cradle attached to said machine housing.

9. A lens conditioning system as claimed in claim 8 wherein said cradle includes at least one through bore through which a connecting rod extends to mechanically link said retainer to a solenoid in said housing.

10. A lens conditioning system as claimed in claim 9 wherein said at least one through bore is two through bores each accepting through passage of a connecting rod.

* * * * *